United States Patent [19]

Menor

[11] Patent Number: 4,642,572

[45] Date of Patent: Feb. 10, 1987

[54] FILTER ADJUSTMENT SYSTEM FOR USE IN ELECTRONIC ACCELERATORS AND THE LIKE

[75] Inventor: George Menor, Martinez, Calif.

[73] Assignee: Siemens Medical Laboratories, Inc., Walnut Creek, Calif.

[21] Appl. No.: 644,842

[22] Filed: Aug. 28, 1984

[51] Int. Cl.[4] ..... H01J 33/04; H01J 3/14

[52] U.S. Cl. ..... 328/228; 313/420; 250/505.1

[58] Field of Search ..... 313/420, 146; 328/228; 250/505.1, 396 R

[56] References Cited

U.S. PATENT DOCUMENTS

| | | | |
|---|---|---|---|
| 2,449,872 | 9/1948 | Brasch et al. | 313/420 |
| 3,040,175 | 6/1962 | Kern | 250/505.1 |
| 3,143,738 | 8/1964 | Bigelow | 250/505.1 X |

*Primary Examiner*—David K. Moore
*Assistant Examiner*—Sandra L. O'Shea
*Attorney, Agent, or Firm*—Mark H. Jay

[57] ABSTRACT

A filter adjustment system for use in electron accelerator and the like includes a plug-shaped ring which engages the filter and is tiltably plugged into an immobile element.

11 Claims, 2 Drawing Figures

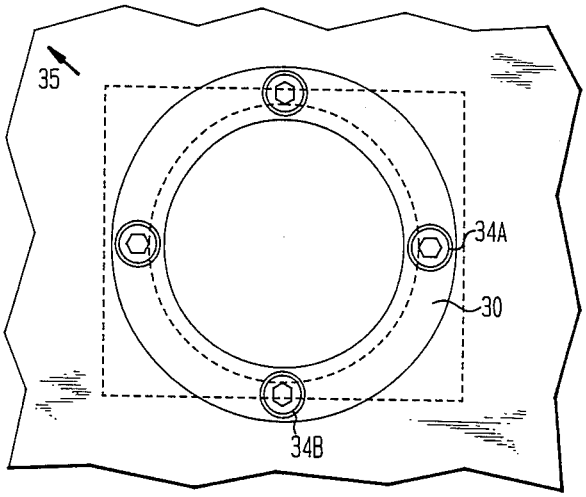
FIG. 2
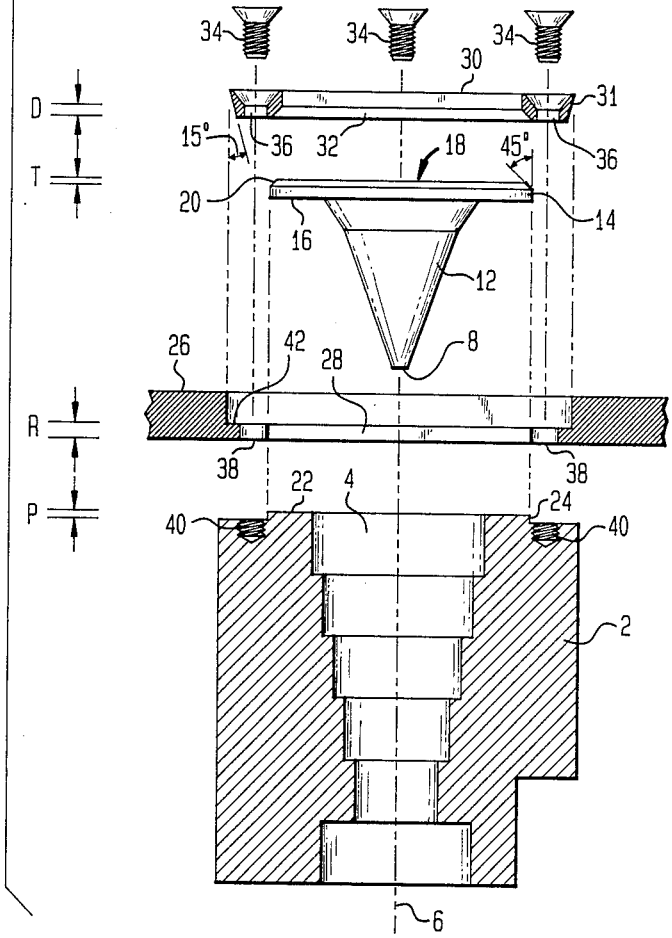

FILTER ADJUSTMENT SYSTEM FOR USE IN ELECTRONIC ACCELERATORS AND THE LIKE

BACKGROUND OF THE INVENTION

In electron accelerators and like equipment, a filter or compensating element for the electron beam must be inserted into the collimator of the machine. This filter is generally conical; its anex must be aligned with the center of the electron beam.

This alignment is critical. Previously, it has been carried out by adjustment of opposed thumbscrews which physically push the filter to the desired position. This is disadvantageous because a excessive space is needed and precise alignment is difficult.

One object of the invention is to provide a system for adjusting a filter in an electronic accelerator and the like, the system making it possible to easily align the filter with the center of the electron beam.

Another object of the invention to provide such a system which is mechanically simple and easy to use.

Yet another object of the invention is to generally improve upon the prior art.

SUMMARY OF THE INVENTION

In accordance with the invention, the collimator or other filter-receiving element is provided with a supporting surface. The filter has a supporting flange at one end. The flange can be placed on the supporting surface and can slide on it for relative movement with respect to the collimator.

In further accordance with the invention, there is provided means for engaging the filter and moving it with respect to the collimator or other element into which it is inserted. This engaging means is tiltably plugged into a fixed object and can be locked so that the filter can be fixed in position once it has been properly aligned.

In a preferred embodiment, the engaging means comprises a ring which receives the flange of the filter and which is plugged into a fixed element such as a plate. The ring can be moved to an appropriate position and locked there by appropriately tightening and loosening fasteners. The fasteners are preferably screws threaded into the collimator in a regular pattern.

The invention will be better understood with reference to the following drawings and the detailed description of preferred embodiments.

BRIEF DESCRIPTION OF THE DRAWINGS

Exemplary and non-limiting preferred embodiments of the invention are shown in the drawings, in which:

FIG. 2 is an exploded side elevation and top view of the embodiment of the invention illustrated in FIG. 1.

DETAILED DESCRIPTION OF PREFERRED EMBODIMENTS

Figure 1:
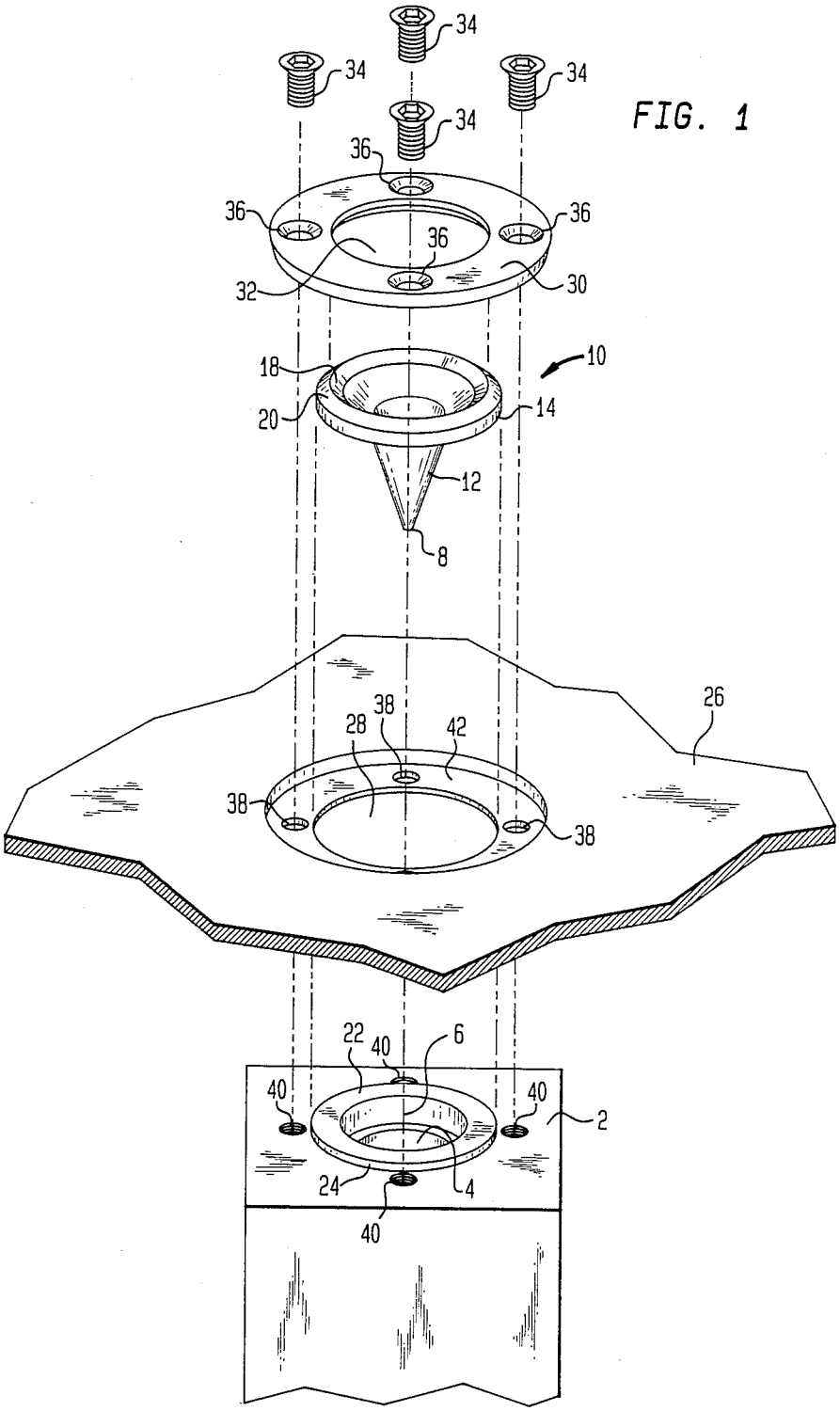
FIG. 1 is a perspective exploded view of a preferred embodiment of the invention.

An electron accelerator or like device has a collimator 2. The collimator 2 (made of, e.g., tungsten) has a central opening 4 through which the electron beam is directed by appropriate means (not shown). The electron beam has a centerline 6 with which the apex 8 of a filter (made of e.g., stainless steel) generally indicated by reference numeral 10 must be aligned.

The filter 10 has a conical compensating member 12 and a supporting flange 14. The flange 14 is secured to the open end of the member 12 opposite to the apex 8. The bottom surface 16 of the flange 14 is flat. The flange 14 has a top surface 18 with a circumferential 45° bevel 20.

A flat support surface 22 is located on the top of a pedestal 24 on the top of the collimator 2. When the compensating member 12 is received within the opening 4 of the collimator 2 and the filter 10 is not locked in position, the bottom surface 16 of the flange rests on and can slide on the support surface 22, so that the filter 10 can move with respect to the collimator 2.

An adjustment ring 30 (made of, e.g., stainless steel) has a recess 32 which has a tapered part that that mates with the bevel 20 of the top surface 18. The top surface 18 includes the bevel 20 so that a positive engagement exists between the flange 14 and the adjustment ring 30. This engagement is desired because movement of the adjustment ring 30 then causes a corresponding movement of the filter 10. However, such positive engagement need not be achieved by the use of a bevel 20; any other shape can be used for the top surface 18 as long as the adjustment ring 30 and the flange 14 positively mate with each other and can be moved slightly with respect to each other. The circumferential edge 31 of the adjustment ring 30 is tapered at a 15° angle so as to form a slightly conical plug.

A carriage plate 26 (made of, e.g., stainless steel) is mounted to the collimator 2 around the pedestal 24. The carrier plate 26 has a circular recess 28. The recess 28 receives the pedestal 24 and the lower part of the flange 14; the recess 28 is slightly larger than the flange 14. The carriage plate 26 also has another recess 42 which receives, and is slightly smaller than, the maximum diameter of the adjustment ring 30. The adjustment ring 30 is thus plugged into the carriage plate 26 and can rock inside it along the circumferential edge 31.

The adjustment ring 30, filter 10, and collimator 2 are all held together by appropriate fasteners. In this example, the fasteners are four screws 34 which pass through holes 36 in the ring 30 and holes 38 in the plate 26, to be threaded into tapped bores 40 in the collimator 2. The screws 34 are preferably arranged in a regular pattern; in this example, the pattern is a square.

The thickness T of the bevel 20 is less than the depth D of the tapered part of the recess 32 in the adjustment ring 30. Furthermore, the recess depth R of the recess 28 is greater than the pedestal height P of the pedestal 24. This structure provides a gap between the bottom of the adjustment ring 30 and the carriage plate 26 so that tightening of the screws 34 causes the filter 10 to be compressed between the adjustment ring 30 and the collimator 2.

Because the adjustment ring 30 is plugged into the recess and the holes 36 are larger than the screws 34, the adjustment ring 30 is moved from side to side as the screws 34 are adjusted. For example, as screw 34A is tightened and the other screws 34 loosened, the adjustment ring 30 moves to the left as viewed in FIG. 2. For another example, as screws 34A and 34B are tightened and the other screws 34 loosened, the adjustment ring moves in the direction of the arrow 35. This movement is facilitated by using pan-head screws 34 (illustrated) and counterboring the holes 36 (as likewise illustrated).

To adjust the filter 10, the filter 10 is approximately centered and the electron beam is swept through the x and y directions. Any mislocation of the apex 8 relative to the centerline of the beam then becomes apparent and the filter 10 is then repositioned by adjusting the screws 34. This is repeated as many times as required.

Those skilled in the art will understand that changes can be made in the preferred embodiments here described, and that these embodiments can be used for other purposes. Such changes and uses are within the scope of the invention, which is limited only by the claims which follow.

What is claimed is:

1. A filter adjustment system for use in electron accelerators and the like for adjusting a filter which has a supporting flange at one end, comprising:

a fixed body having a supporting surface upon which said flange can be placed; and means for engaging the filter and sliding it on said supporting surface, said engaging means being tiltably plugged into an immobile element, engaging the filter, and sliding the filter on said supporting surface upon being tilted.

2. The system of claim 1, wherein said engaging means is a plug-shaped ring which is received in an opening in the immobile element.

3. The system of claim 1, wherein said engaging means engages said flange.

4. The system of claim 3, wherein said engaging means positively mates with said flange.

5. The system of claim 4, wherein said flange has a bevelled top surface and said engaging means has a recess mating with said top surface.

6. The system of claim 2, further comprising loosenable fastening means for urging the ring against the immobile element.

7. The system of claim 6, wherein said fastening means comprises a plurality of screws.

8. The system of claim 7, wherein the screws are located at regular intervals around the ring.

9. The system of claim 8, wherein there are four screws arranged in a square.

10. In combination:

a filter comprising a conical compensating member and an annular supporting flange at an end of the member, the flange having a bevelled top surface and a bottom surface;

a collimator having an opening for receiving said member and a supporting surface upon which said bottom surface can slide;

a carriage plate having a first recess surrounding and spaced from the flange and a second recess for receiving an adjustment ring;

a plug-shaped adjustment ring positively mating with said top surface and being tiltably received in said second recess, the adjustment ring sliding the filter on said supporting surface upon being tilted; and means for releasably locking the adjustment ring, filter and collimator with respect to each other.

11. The combination of claim 10, wherein said releasable locking means comprises a plurality of screws which pass through the adjustment ring at regular intervals and are threaded into the collimator.

* * * * *